US009476556B2

(12) United States Patent
Kracker et al.

(10) Patent No.: US 9,476,556 B2
(45) Date of Patent: Oct. 25, 2016

(54) VEHICLE HEADLIGHT ASSEMBLY

(71) Applicant: HONDA MOTOR CO., LTD., Minato-ku, Tokyo (JP)

(72) Inventors: Thomas G. Kracker, Marysville, OH (US); Tony Da-Tung Wang, Marysville, OH (US); Francisco Americo Ramos, Toledo, OH (US); Darrin T. Roberts, Plain City, OH (US); Shinichi Todaka, Dublin, OH (US); Dean Bowles, Commerce, MI (US); Ippei Yamamoto, Shizuoka (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/146,409

(22) Filed: Jan. 2, 2014

(65) Prior Publication Data

US 2014/0192548 A1 Jul. 10, 2014

Related U.S. Application Data

(60) Provisional application No. 61/748,902, filed on Jan. 4, 2013.

(51) Int. Cl.
*B60Q 1/00* (2006.01)
*F21S 8/10* (2006.01)

(52) U.S. Cl.
CPC ..... *F21S 48/1159* (2013.01); *F21S 48/1258* (2013.01); *F21S 48/1283* (2013.01); *F21S 48/1382* (2013.01); *F21S 48/15* (2013.01)

(58) Field of Classification Search
CPC ..... F21S 48/1159; F21S 48/115; F21S 48/1154; F21S 48/1388; F21V 11/04
USPC ..... 362/538, 516, 517
See application file for complete search history.

(56) References Cited

U.S. PATENT DOCUMENTS

| | | | | |
|---|---|---|---|---|
| 7,178,957 | B2 | 2/2007 | Schug et al. | |
| 7,201,501 | B2 | 4/2007 | Chigusa et al. | |
| 7,347,600 | B2 | 3/2008 | Albou | |
| 7,419,290 | B2 | 9/2008 | Inaba | |
| 7,543,964 | B2 | 6/2009 | Albou | |
| 7,731,402 | B2 | 6/2010 | Tessnow et al. | |
| 7,850,353 | B2 | 12/2010 | Ota et al. | |
| 7,988,346 | B2 | 8/2011 | Helms et al. | |
| 8,297,816 | B2 * | 10/2012 | Matsumoto et al. | 362/545 |
| 8,360,626 | B2 * | 1/2013 | Tsukamoto | 362/539 |
| 2001/0021112 | A1 * | 9/2001 | Taniuchi et al. | 362/518 |
| 2003/0090906 | A1 * | 5/2003 | Hayakawa | 362/517 |
| 2003/0107901 | A1 * | 6/2003 | Tokoro et al. | 362/538 |
| 2006/0164852 | A1 * | 7/2006 | Mochizuki et al. | 362/539 |
| 2006/0171162 | A1 * | 8/2006 | Naganawa | F21S 48/1145 362/539 |
| 2007/0019431 | A1 * | 1/2007 | Kinoshita | 362/517 |

(Continued)

*Primary Examiner* — Anh Mai
*Assistant Examiner* — Matthew Peerce
(74) *Attorney, Agent, or Firm* — Arent Fox LLP

(57) ABSTRACT

A reflector configured to receive and reflect illumination from an illumination device across a projector lens of a vehicle headlight assembly. The reflector includes a reflection surface, a curved edge adjacent to the reflection surface and defining a lower illumination aperture, and a wall member extending across the lower illumination aperture to define a gap portion between the wall member and the curved edge. The wall member is configured to reduce illumination reflected from the reflection surface by blocking an amount of illumination passing through the lower illumination aperture.

15 Claims, 12 Drawing Sheets

(56) References Cited

U.S. PATENT DOCUMENTS

| | | | | |
|---|---|---|---|---|
| 2007/0236953 | A1* | 10/2007 | Nakazawa et al. | 362/544 |
| 2008/0198617 | A1* | 8/2008 | Schwab et al. | 362/545 |
| 2008/0239741 | A1* | 10/2008 | Nakada et al. | 362/507 |
| 2008/0239742 | A1* | 10/2008 | Nakada et al. | 362/507 |
| 2009/0257240 | A1* | 10/2009 | Koike | 362/538 |
| 2010/0002457 | A1* | 1/2010 | Takada | 362/509 |
| 2010/0110716 | A1* | 5/2010 | Nakada | 362/538 |
| 2011/0032722 | A1* | 2/2011 | Ishida et al. | 362/538 |
| 2011/0199777 | A1* | 8/2011 | Naganawa | 362/539 |
| 2012/0051078 | A1* | 3/2012 | Kinoshita | 362/538 |
| 2012/0063156 | A1* | 3/2012 | Yasuda et al. | 362/516 |
| 2012/0140503 | A1* | 6/2012 | Ahn et al. | 362/514 |
| 2013/0010488 | A1* | 1/2013 | Koizumi | F21S 48/1154 362/517 |
| 2013/0021817 | A1* | 1/2013 | Ishida | 362/517 |
| 2013/0215634 | A1* | 8/2013 | Tseng | 362/516 |

* cited by examiner

VEHICLE HEADLIGHT ASSEMBLY

CROSS-REFERENCE TO RELATED APPLICATIONS

This application claims priority to U.S. Provisional Patent Application No. 61/748,902 filed on Jan. 4, 2013.

FIELD

The disclosure relates in general to a headlight assembly for a vehicle and, more particularly, to a vehicle headlight assembly that limits abnormal light emissions while maintaining illuminating area and brightness requirements.

BACKGROUND

Vehicle headlights include a housing with a set of illumination devices, such as light emitting diodes (LEDs), positioned behind one or more lenses. Lens and LED positioning is selected to provide adequate brightness and illuminating area that appeals to the eye and follows current regulations. Some headlight designs include a recessed illumination device set and lenses with an extension above and/or below the lenses. In order to meet the above regulations for brightness and illuminating area, a substantial amount of light from the illumination devices is reflected along the extension. This "stray light" along the extension is not visually appealing, nor does it provide useful illumination. Therefore, there is a need for a headlight assembly that meets regulations for brightness and illuminating area as well as minimizes abnormal or stray light reflections.

SUMMARY

The disclosure relates in general to a headlight assembly for a vehicle and, more particularly, to a vehicle headlight assembly that limits abnormal light emissions while maintaining illuminating area and brightness requirements.

In one implementation, the present disclosure is directed to a vehicle headlight assembly. The assembly includes a housing defining a housing window and including an extension extending along a lower portion of the housing window. The assembly also includes an illumination device, a projector lens, and a reflector. The illumination device is positioned within the housing, and the projector lens positioned within the housing and in front of the illumination device. The reflector is positioned within the housing and configured to reflect illumination from the illumination device across the projector lens and through the housing window. The reflector includes a curved edge defining a lower illumination aperture and a wall member extending across the lower illumination aperture to define a gap portion between the wall member and the curved edge of the lower illumination aperture. The wall member is configured to reduce illumination reflected from the reflector across the projector lens and striking the extension by blocking an amount of illumination passing through the lower illumination aperture.

In another implementation, the present disclosure is directed toward a reflector configured to receive and reflect illumination from an illumination device across a projector lens of a vehicle headlight assembly including a housing with an extension. The reflector includes a reflection surface, a curved edge adjacent to the reflection surface and defining a lower illumination aperture, and a wall member extending across the lower illumination aperture to define a gap portion between the wall member and the curved edge. The wall member is configured to reduce illumination reflected from the reflection surface by blocking an amount of illumination passing through the lower illumination aperture.

DETAILED DESCRIPTION OF THE DRAWINGS

The disclosure relates in general to a headlight assembly for a vehicle and, more particularly, to a vehicle headlight assembly that limits abnormal light emissions while maintaining illuminating area and brightness requirements.

The present system and method is presented in several varying embodiments in the following description with reference to the Figures, in which like numbers represent the same or similar elements. References throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment.

The described features, structures, or characteristics of the disclosure may be combined in any suitable manner in one or more embodiments. In the following description, numerous specific details are recited to provide a thorough understanding of embodiments of the system. One skilled in the relevant art will recognize, however, that the system and method may both be practiced without one or more of the specific details, or with other methods, components, materials, and so forth. In other instances, well-known structures, materials, or operations are not shown or described in detail to avoid obscuring aspects of the disclosure.

Figure 1:
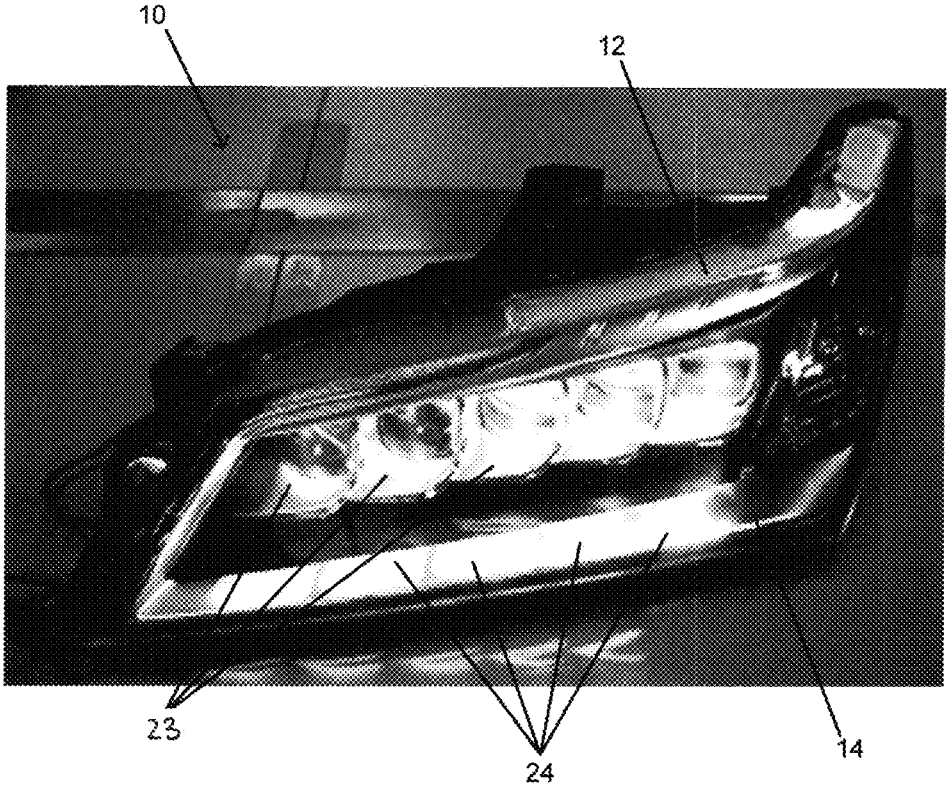
FIG. 1 is a perspective view of an operating headlight assembly in accordance with prior art designs.
Figure 2:
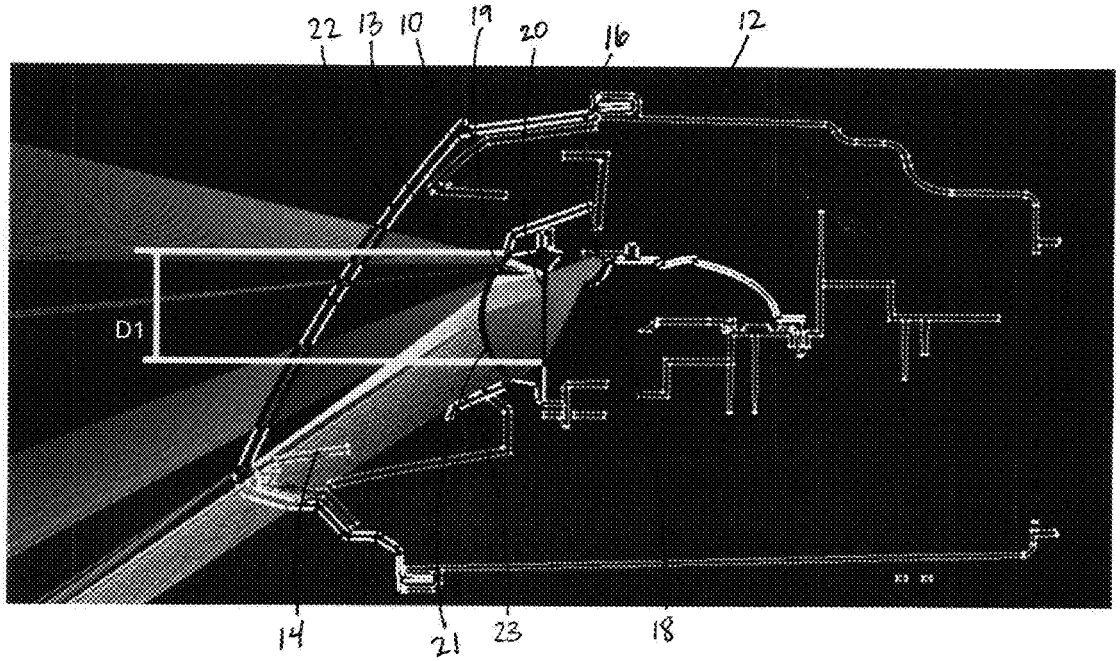
FIG. 2 is a schematic illustration of the headlight assembly of FIG. 1.

FIGS. 1 and 2 are illustrations of a vehicle headlight assembly 10 according to prior art designs. The vehicle headlight assembly 10 includes a housing 12 with a window 13 and an extension 14 extending along a lower portion of the window 13. The vehicle headlight assembly 10 also includes a set of LEDs or other light emitting devices 16 each housed within individual reflectors 18 and a recessed projector lens 19 including a first, inner side 20 and a second, outer side 21 positioned in front of each of the LEDs 16. As shown in FIG. 2, the inner side 20 of the projector lens 19 is substantially flat, while the outer side 21 is substantially concave in shape. In addition, a transparent cover 22 is provided to cover the window 13 and the extension 14 (as best shown in FIG. 2), and inner extensions 23 are positioned around each LED 16 (as shown in FIGS. 1 and 2).

As shown in FIG. 2, the reflectors 18, the lenses 19, and the LEDs 16 are positioned inside the housing 12. The lenses 19 are positioned in front of the LEDs 16 and the reflectors 18 (in one example, provided as a reflector assembly including five connected reflectors 18) are configured to reflect illumination from the LEDs 16 across the lenses 19. Furthermore, the reflectors 18 and the lenses 19 are configured to direct light from the LEDs 16 outward from the headlight assembly 10, that is, through the window 13, in a visually appealing manner and in compliance with a number of regulations, including brightness and illuminating area regulations. More specifically, the reflectors 18 and the lenses 19 (and/or the cover 22) are designed to direct light from the LEDs 16 outward from the headlight assembly 10 to give the appearance of a thin line of light across a top portion of the lenses 19 in order to provide daytime running lamp (DRL) functionality of the vehicle headlight assembly 10. In other words, the reflectors 18, the lenses 19, and the LEDs 16 are configured to operate as a DRL.

Figure 3A:
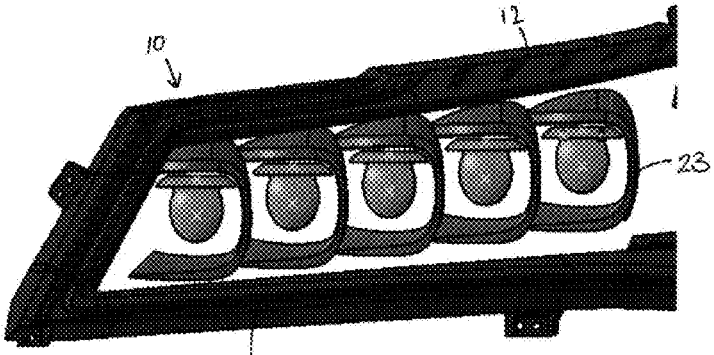
FIGS. 3A-3C are front, 45-degree inboard, and 45-degree outboard illumination illustrations, respectively, of the headlight assembly of FIG. 1.
Figure 3B:
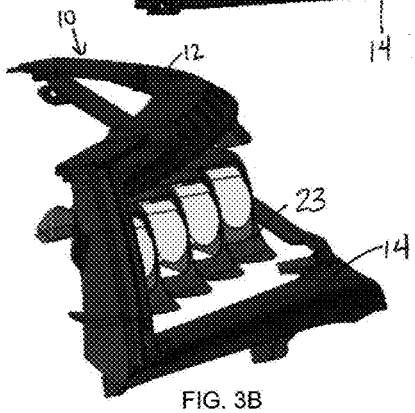
Figure 3C:
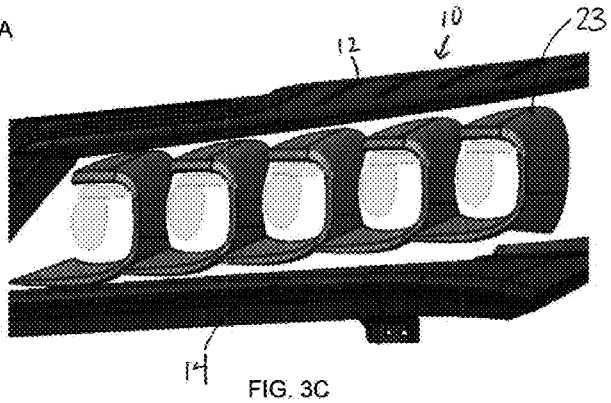

For example, FIG. 2 depicts illumination ray traces of the headlight assembly 10. As shown in FIG. 2, an illuminating surface D1 of the lens 19 (e.g., of the flat side 20) is relatively large, allowing for compliance in meeting regulations for illuminating area at different viewing angles such as front view, 45 degree inboard view, 45 degree outboard view, etc. In particular, as shown in FIGS. 3A-3C, the design of FIG. 2 provides a front illumination area of about 52.5 square centimeters (complying with a 25-square centimeter requirement), a 45-degree inboard illumination area of about 22.4 square centimeters (complying with a 10-square centimeter requirement), and a 45-degree outboard illumination area of about 35.7 square centimeters (complying with a 10-square centimeter requirement). In other words, this design provides illumination to a sufficient surface area of each lens 19, with light being visible across a top portion of the lenses 19 and not visible, or minimally visible, across the rest of the lenses 19 (i.e., due to high-intensity illumination reaching the top portions and only scattered/low-intensity illumination reaching the rest of the lenses, as shown in FIG. 2), thus providing a good DRL appearance. However, the design also provides a substantial amount of illumination along the extension 14. As a result, as shown in FIG. 1, a number of reflection areas 24 of "stray light" appear on the extension 14.

Figure 4:
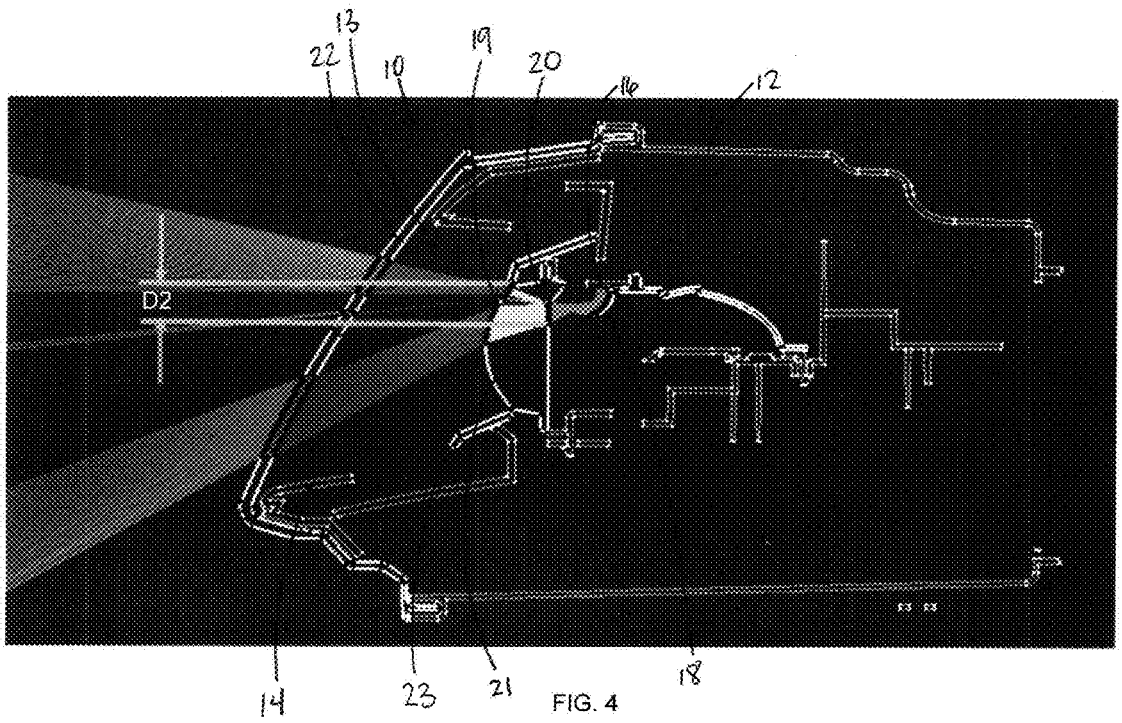
FIG. 4 is a schematic illustration of a headlight assembly according to another prior art design.
Figure 5A:
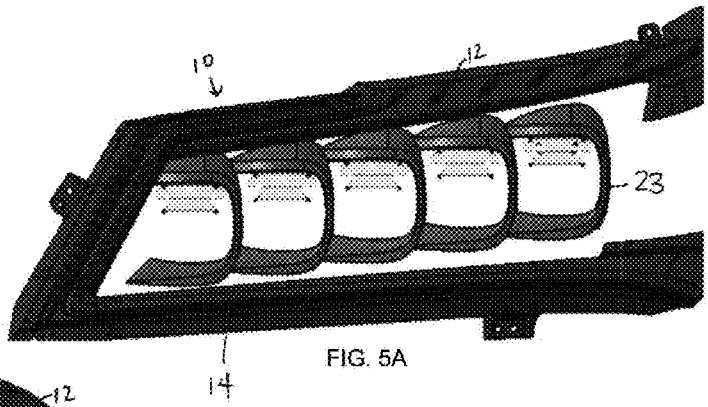
FIGS. 5A-5C are front, 45-degree inboard, and 45-degree outboard illumination illustrations, respectively, of the headlight assembly of FIG. 4.
Figure 5B:
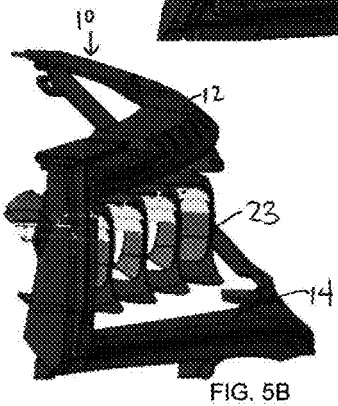
Figure 5C:
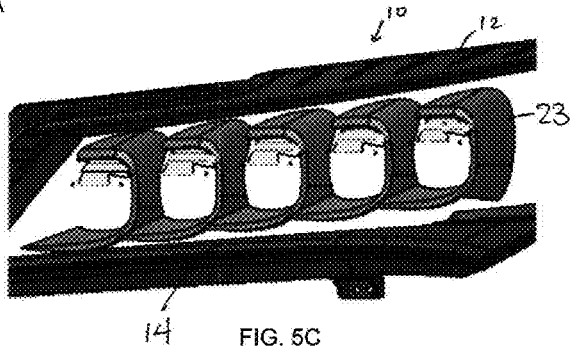

Simply covering the illuminating surface to prevent all illumination traces from reaching the extension 14 is not a feasible solution. For example, as shown in FIG. 4, a smaller illuminating surface D2 is presented that prevents illumination of the extension 14. This design may be visually appealing because high intensity illumination provides visible light along top portions of the lenses 19 and there is no reflection areas along the extension 24. However, the smaller illuminating surface D2 of this design is not large enough to meet regulation standards in terms of illuminating area. More specifically, as shown in FIGS. 5A-5C, the design of FIG. 4 provides an front illumination area of about 23.1 square centimeters (not meeting the 25-square centimeter requirement), a 45-degree inboard illumination area of about 8.5 square centimeters (not meeting the 10-square centimeter requirement), and a 45-degree outboard illumination area of about 16.8 square centimeters (complying with the 10-square centimeter requirement).

Figure 6:
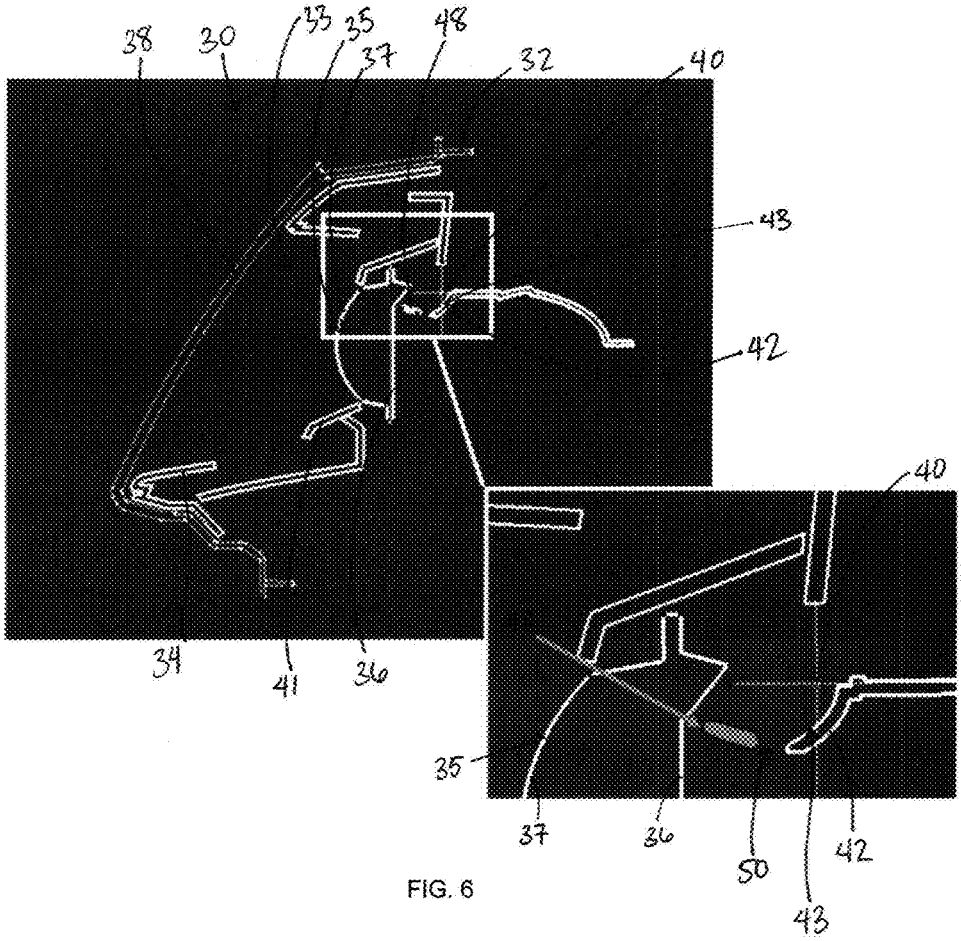
FIG. 6 is a schematic illustration of a headlight assembly in accordance with the present disclosure.

In contrast, the headlight assembly of the present disclosure provides minimized light reflection along the extension while maintaining good visual appearance and complying with illumination and brightness regulations. As shown in FIG. 6, a headlight assembly 30 of the present disclosure includes a housing 32 with a window 33 and an extension 34 extending along a lower portion of the window 33, a set of recessed projector lenses 35 each including a first, inner side 36 (i.e., a substantially flat side) and a second, outer side 37 (i.e., a substantially convex side), an outer cover 38, a set of LEDs 40 individually housed within the reflectors 42, and inner extensions 41.

Figure 7B:
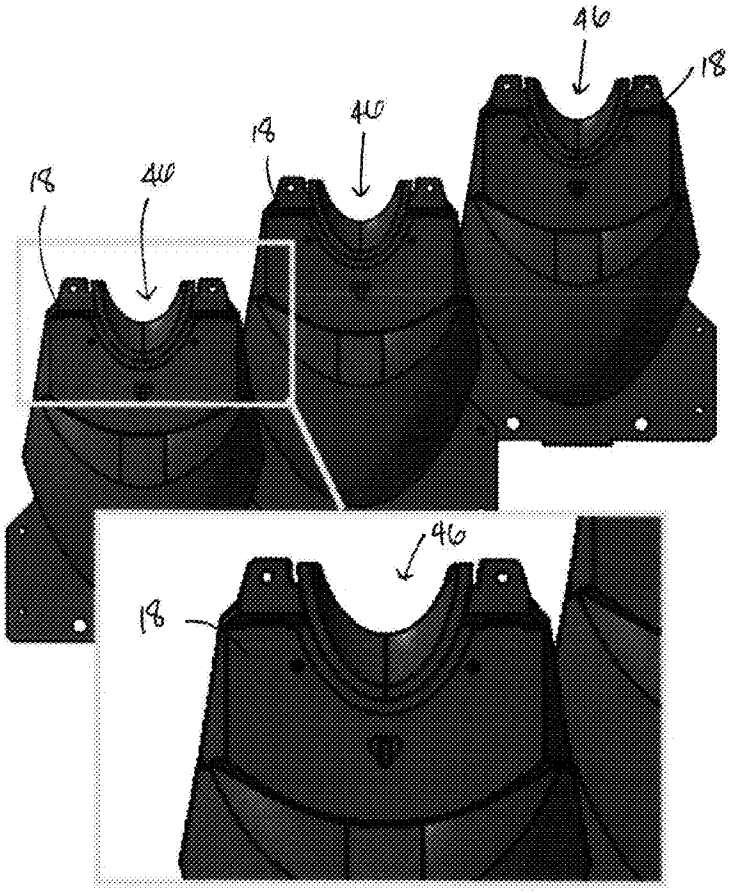
FIG. 7B is a perspective view of a series of reflectors for use with the headlight assembly of FIG. 1.
Figure 7A:
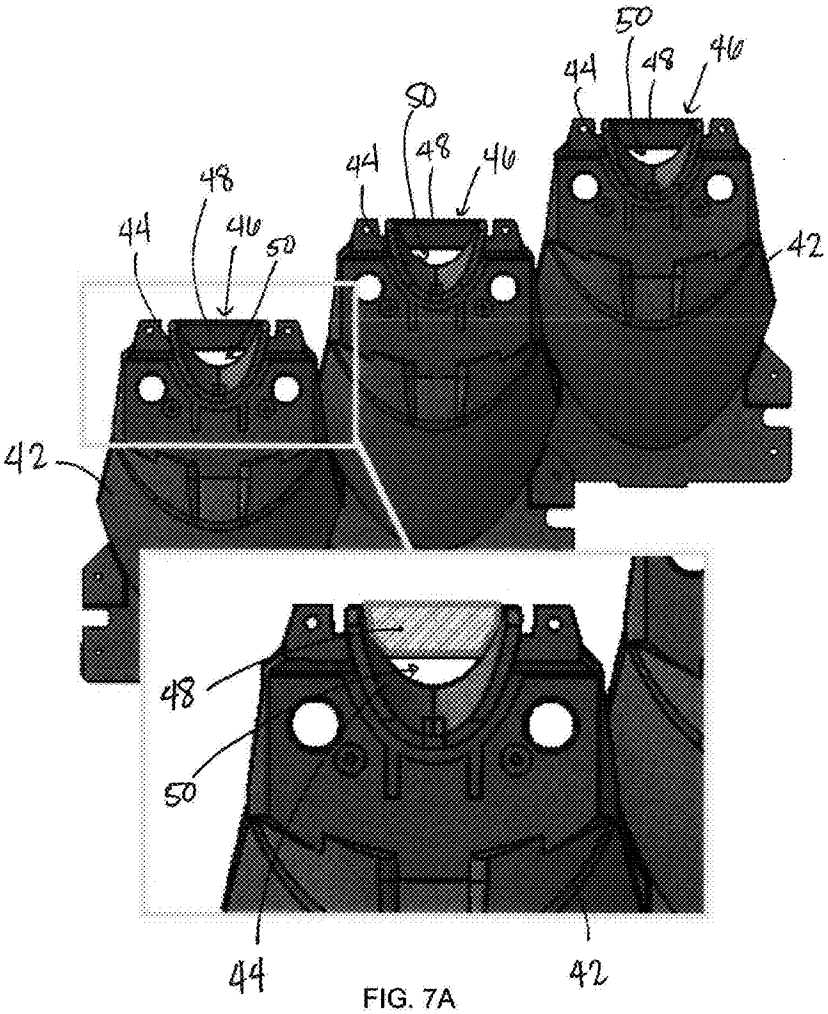
FIG. 7A is a perspective view of a series of reflectors for use with the headlight assembly of FIG. 6.
Figure 8:
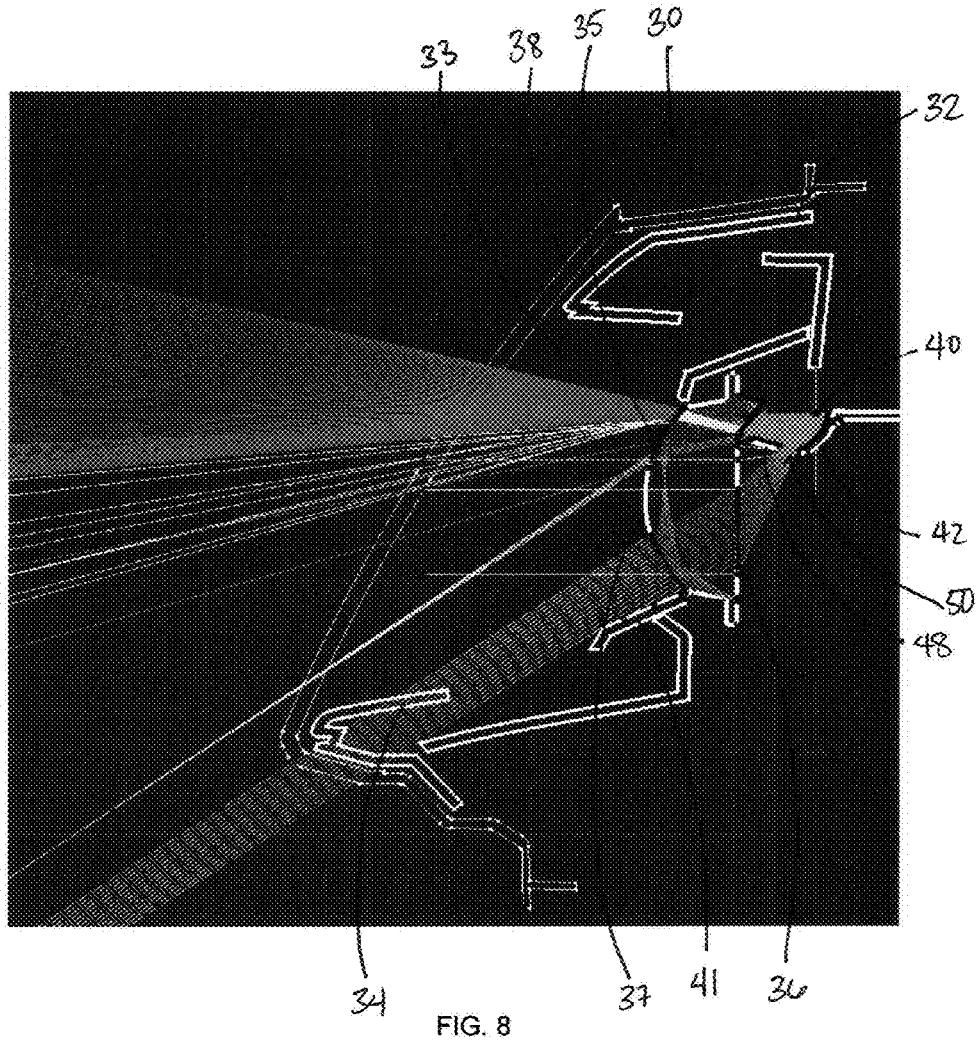
FIG. 8 is another schematic illustration of the headlight assembly of FIG. 6.
Figure 9A:
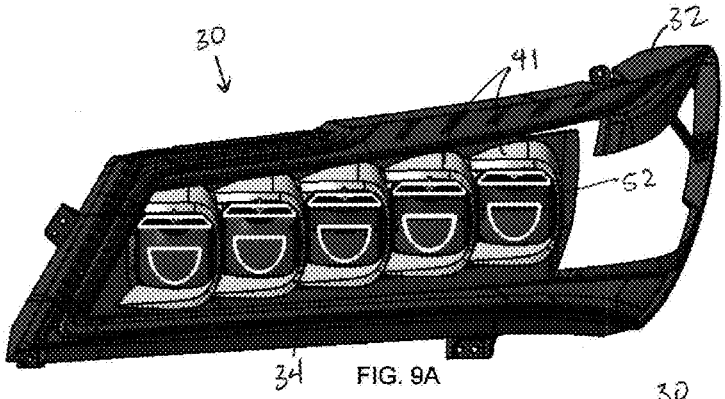
FIGS. 9A-9C are front, 45-degree inboard, and 45-degree outboard illumination illustrations, respectively, of the headlight assembly of FIG. 6.
Figure 9B:
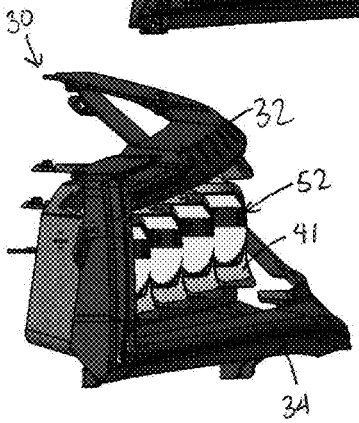
Figure 9C:
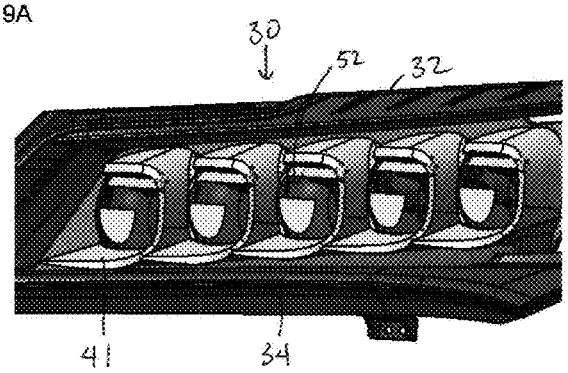

According to the present disclosure, as shown in FIGS. 6 and 7A, each reflector 42 includes a reflection surface 43 configured to reflect illumination from the LED 40 across the projector lens 35. A lower portion of each reflector 42 includes a curved edge 44 providing a lower illumination aperture 46, and a wall member 48 extends across this lower illumination aperture 46, as shown in FIG. 7A, and attaches to either side of the curved edge 44. The wall member 48 extends across the lower illumination aperture 46 to block illumination from a respective LED 40, and a small gap 50 is still provided between the wall member 48 and the curved edge 44 to allow passage of some illumination. In contrast, as shown in FIG. 7B, previous reflector designs allow passage of illumination through the entire lower illumination aperture 46. The wall member 48 of the present headlight assembly is configured to constrain light exiting the headlight assembly 30 in order to improve appearance by constraining light away from extension 34, while still meeting minimum illuminating surface area requirements. More specifically, as shown in FIG. 8, the wall member 48 blocks most illumination that would normally reflect off the reflecting surface 43 and reach the extension 34, but, due to the gap 50, still allows a large illumination surface on the lens 36. This is also illustrated in FIGS. 9A-9C, where most of the lens 36 receives illumination. Despite minor blocked regions 52 along the lens surfaces 35, illumination surface area requirements are still met, in addition to standard brightness requirements. Furthermore, referring back to FIG. 8, the design provides high or strong intensity illumination (i.e., maximum light values) only along top portions of the lenses 35, whereas prior art designs, such as that shown in FIG. 1, provide high intensity illumination along top portions of the lenses 35 as well as other portions along the lens surfaces 35. These other portions of high intensity illumination are unwanted during DRL functionality.

Figure 10A:
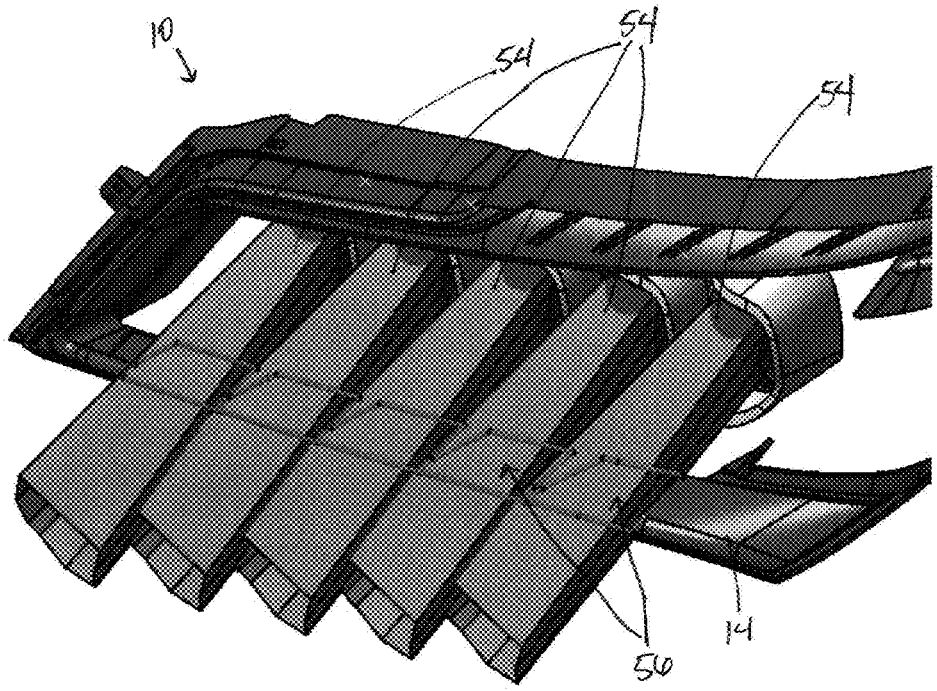
FIGS. 10A-10C are front, side, and top view illustrations, respectively, of illumination areas along an extension of the headlight assembly of FIG. 1.
Figure 11A:
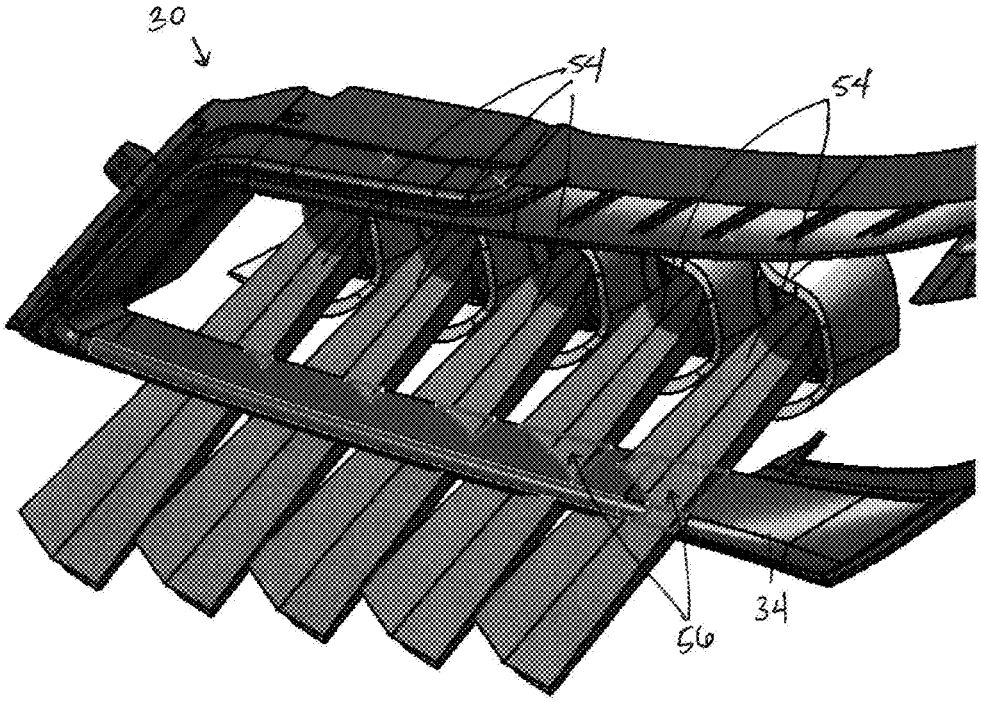
FIGS. 11A-11C are front, side, and top view illustrations, respectively, of illumination areas along an extension of the headlight assembly of FIG. 6.
Figure 10B:
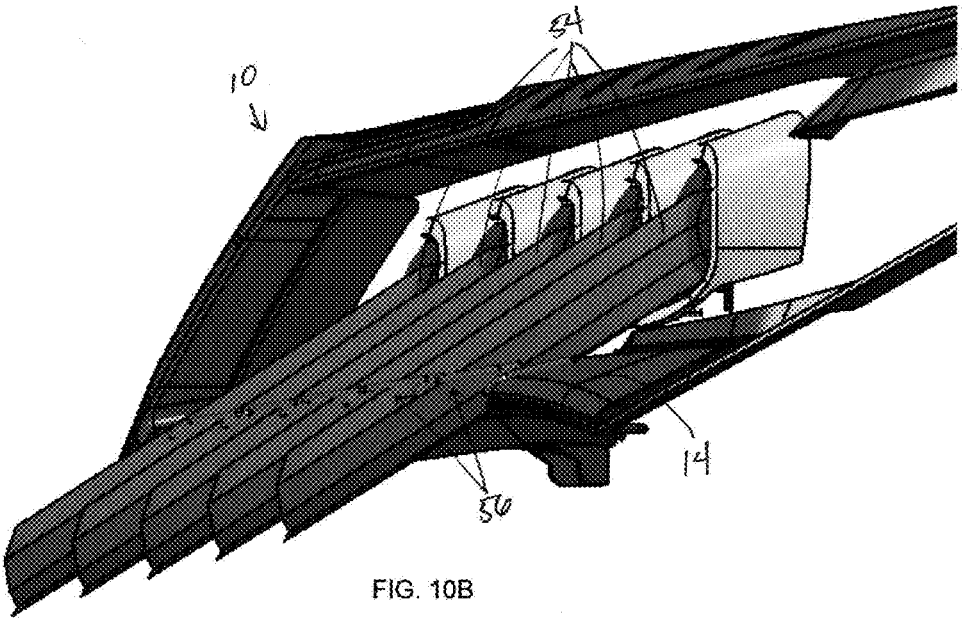
Figure 11B:
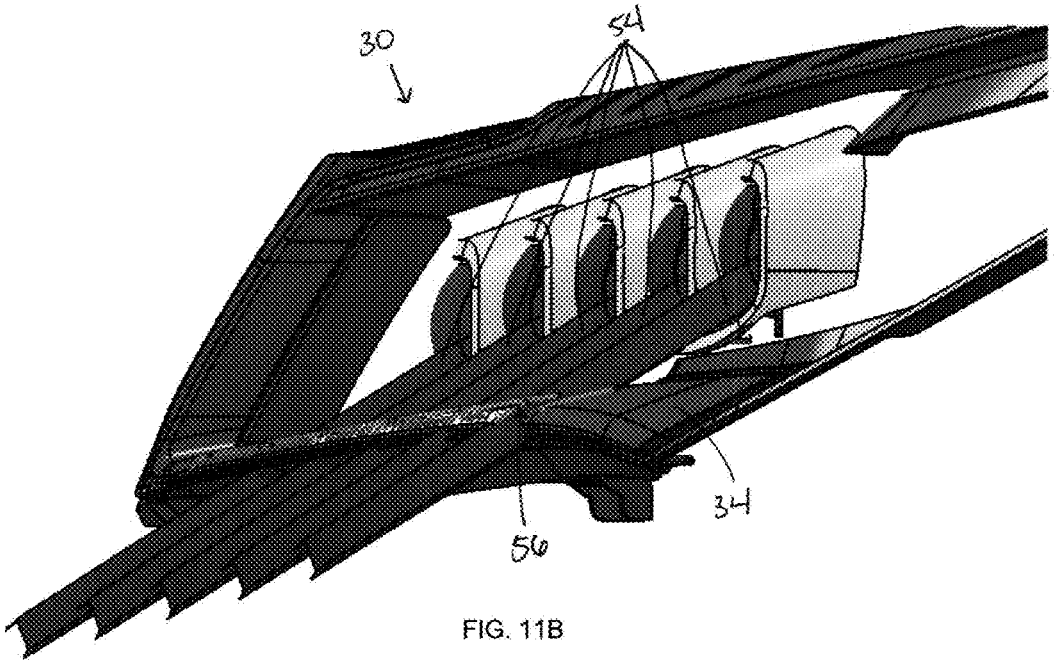
Figure 10C:
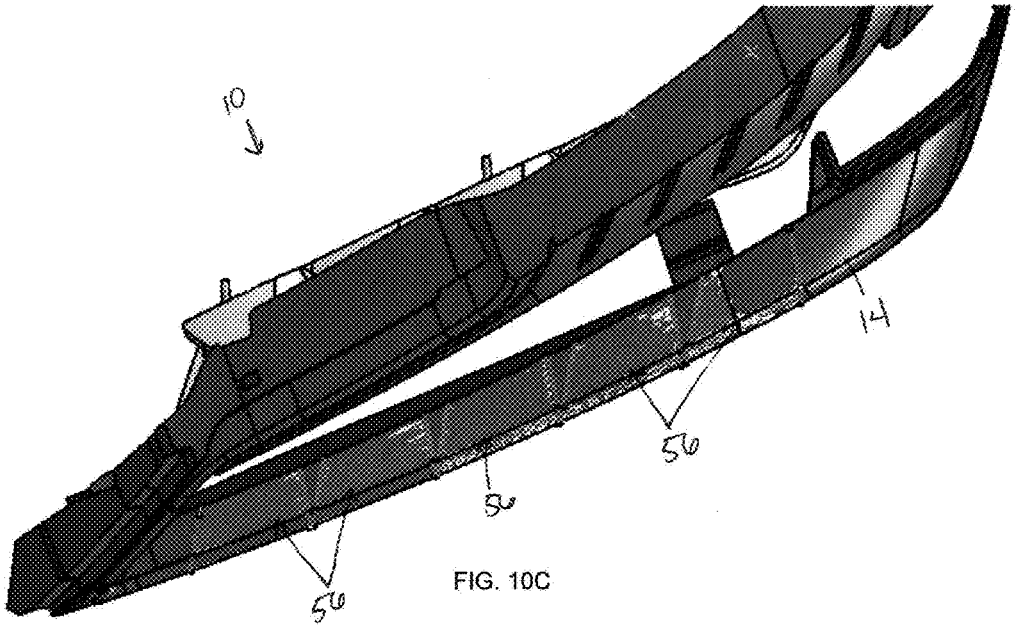
Figure 11C:
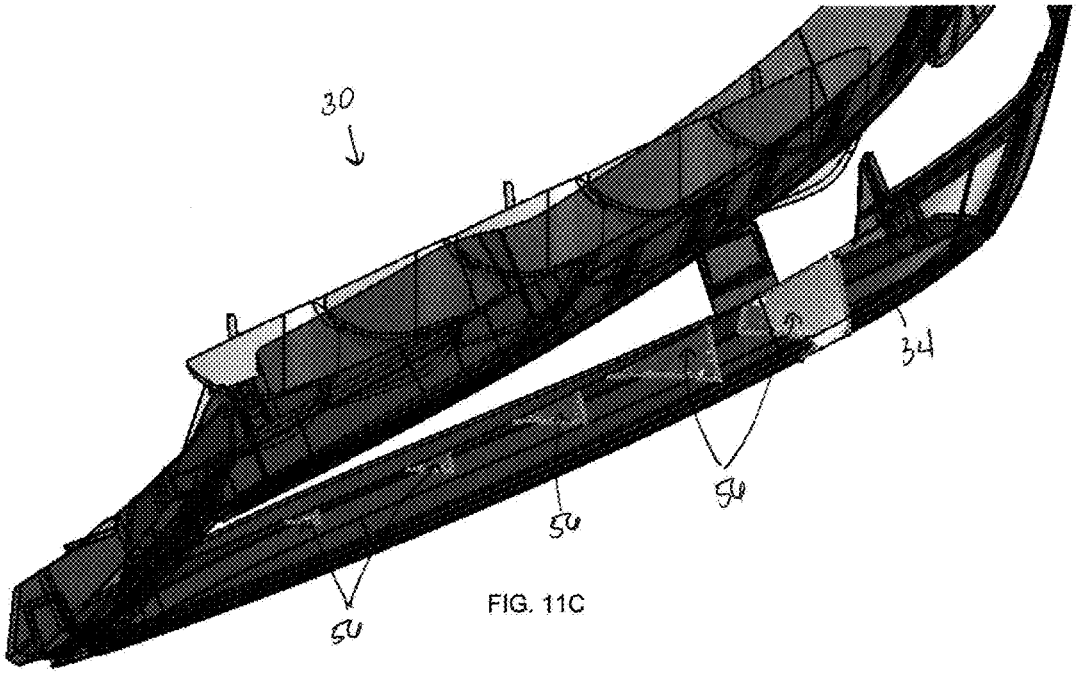
Figure 12A:
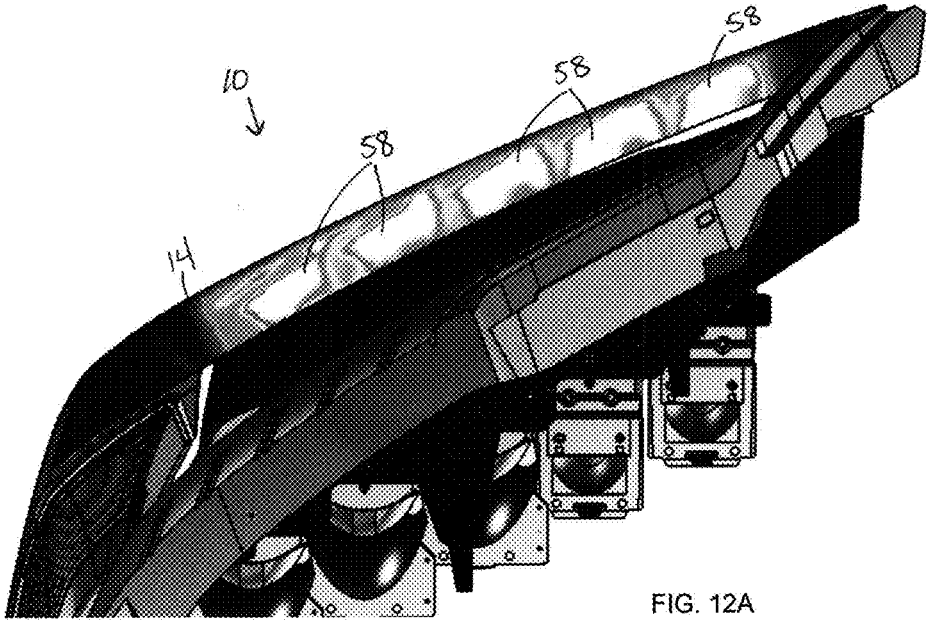
FIG. 12A is a top view illustration of brightness along an extension of the headlight assembly of FIG. 1.
Figure 12B:
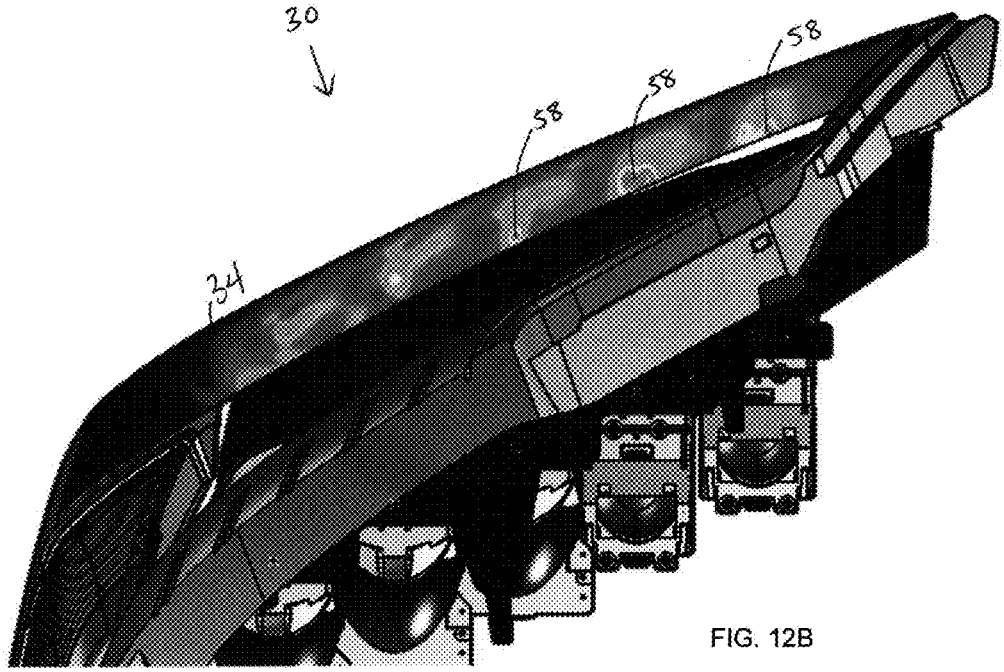
FIG. 12B is a top view illustration of brightness along an extension of the headlight assembly of FIG. 6.
Figure 12C:
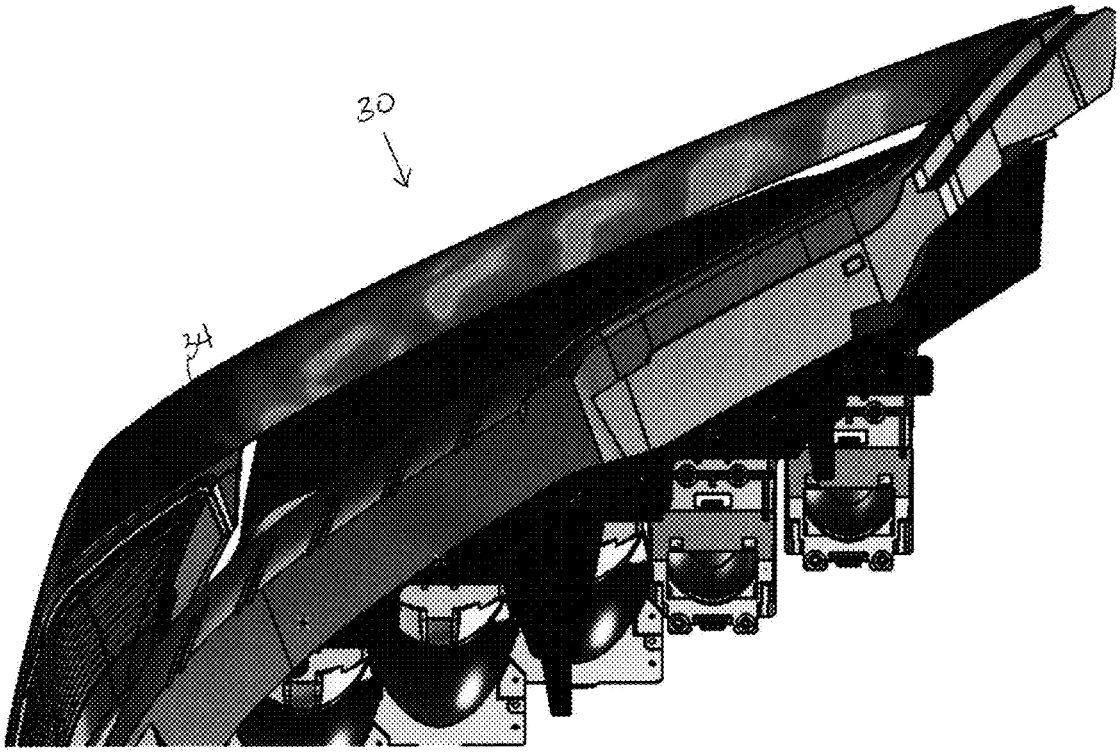
FIG. 12C is a top view illustration of brightness along an extension of the headlight assembly of FIG. 6, including a textured outer lens.

FIGS. 10A-10C illustrate illumination ray traces 54 along the extension 14 in prior art designs from front, side, and top views, respectively. FIGS. 11A-11C illustrate illumination ray traces 54 along the extension 34 using designs of the present disclosure from front, side, and top views, respectively. As shown in FIGS. 10A-11C, reflection areas 56 are minimized on the extension 34 of the headlight arrangement, in comparison to the extension 14 of prior art designs. FIGS. 12A-12C further illustrate this comparison. FIG. 12A illustrates an illumination simulation along the extension 14 of prior art designs. As shown in FIG. 12A, a large number of illumination "hot spots" 58 exist along the extension 14 (i.e., corresponding to a large amount of illumination along the extension 14). In comparison, FIG. 12B illustrates an illumination simulation along the extension 34 of the present headlight arrangement. As shown in FIG. 12B, illumination hot spots 58 are greatly minimized due to the wall member 48 substantially blocking illumination from reaching the extension 34. In addition, FIG. 12C illustrates an illumination simulation along the extension 34 of the present headlight arrangement when the convex side 37 of the lens 35 is textured (not shown). The combination of the wall member 48 and the textured lens 35 eliminates illumination hot spots 58 along the extension 34.

Although the present disclosure has been presented with respect to preferred embodiment(s), any person skilled in the art will recognize that changes may be made in form and detail, and equivalents may be substituted for elements of the disclosure without departing from the spirit and scope of the disclosure. Therefore, it is intended that the disclosure not be limited to the particular embodiments disclosed, but will include all embodiments falling within the scope of the appended claims.

What is claimed is:

1. A vehicle headlight assembly, comprising:

a housing defining a housing window and including an extension extending along a lower portion of the housing window;

an illumination device positioned within the housing;

a projector lens positioned within the housing and in front of the illumination device; and a reflector positioned within the housing and configured to reflect illumination from the illumination device across the projector lens and through the housing window, the reflector including:

a curved edge defining a lower illumination aperture, and a wall member extending across the lower illumination aperture to define a gap portion between the wall member and the curved edge of the lower illumination aperture, wherein the wall member is configured to reduce illumination reflected from the reflector across the projector lens and striking the extension by blocking an amount of illumination passing through the lower illumination aperture, such that light exiting the vehicle headlight assembly through the gap portion has an intensity less than that of light exiting along top portions of the projector lens, wherein only the top portions of the projector lens are provided with the maximum light intensity illumination, and the illumination striking the extension is controlled for achieving a selected illumination surface area at different viewing angles.

2. The vehicle headlight assembly of claim 1, wherein the illumination device, the projector lens, and the reflector are configured to operate as a daytime running lamp.

3. The vehicle headlight assembly of claim 1, wherein the reflector is configured to reflect illumination at a higher intensity across a top portion of the projector lens than across other portions of the projector lens.

4. The vehicle headlight assembly of claim 1, wherein the reflector is configured to reflect illumination across the projector lens so that light is visible at least across a top portion of the projector lens.

5. The vehicle headlight assembly of claim 1, wherein the vehicle headlight assembly includes a reflector assembly including five reflectors.

6. The vehicle headlight assembly of claim 1, wherein the projector lens includes a flat side and a convex side, and wherein the flat side is positioned closer to the illumination device than the convex side.

7. The vehicle headlight assembly of claim 6, wherein the convex side includes a textured surface.

8. The vehicle headlight assembly of claim 1, wherein the illumination device includes a light emitting diode.

9. The vehicle headlight assembly of claim 1, wherein the wall member of the reflector is coupled to each side of the curved edge.

10. The vehicle headlight assembly of claim 1, further comprising a cover positioned over the housing window of the housing.

11. A reflector configured to receive and reflect illumination from an illumination device across a projector lens of a vehicle headlight assembly including a housing with an extension, the reflector comprising:

a reflection surface;

a curved edge adjacent to the reflection surface and defining a lower illumination aperture; and a wall member extending across the lower illumination aperture to define a gap portion between the wall member and the curved edge, wherein the wall member is configured to reduce illumination reflected from the reflection surface and striking the extension by blocking an amount of illumination passing through the lower illumination aperture, such that light exiting the vehicle headlight assembly through the gap portion has an intensity less than that of light exiting along top portions of the projector lens, wherein only the top portions of the projector lens are provided with the maximum light intensity illumination, and the illumination striking the extension is controlled for achieving a selected illumination surface area at different viewing angles.

12. The reflector of claim 11, wherein the reflection surface, the curved edge, and the wall member are configured to operate with the illumination device and the projector lens as a daytime running lamp.

13. The reflector of claim 11, wherein the reflection surface is configured to reflect illumination at a higher intensity across a top portion of the projector lens than across other portions of the projector lens.

14. The reflector of claim 11, wherein the reflection surface is configured to reflect illumination across the projector lens so that light is visible at least across a top portion of the projector lens.

15. The reflector of claim 11, wherein the wall member is coupled to each side of the curved edge of the reflector.

* * * * *